US009259742B2

(12) United States Patent
Roux et al.

(10) Patent No.: US 9,259,742 B2
(45) Date of Patent: Feb. 16, 2016

(54) ELECTROSTATIC COLLECTING SYSTEM FOR SUSPENDED PARTICLES IN A GASEOUS MEDIUM

(71) Applicants: COMMISSARIAT A L'ENERGIE ATOMIQUE ET AUX ENE ALT, Paris (FR); CENTRE NATIONAL DE LA RECHERCHE SCIENTIFIQUE, Paris Cedex (FR)

(72) Inventors: Jean-Maxime Roux, Grenoble (FR); Jean-Luc Achard, Grenoble (FR)

(73) Assignees: Commissariat à l'énergie atomique et aux énergies alternatives, Paris (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 315 days.

(21) Appl. No.: 13/871,552

(22) Filed: Apr. 26, 2013

(65) Prior Publication Data

US 2013/0284024 A1 Oct. 31, 2013

(30) Foreign Application Priority Data

Apr. 27, 2012 (FR) ..... 12 53945

(51) Int. Cl.
*B03C 3/78* (2006.01)
*B03C 3/12* (2006.01)
(Continued)

(52) U.S. Cl.
CPC ... *B03C 3/78* (2013.01); *B03C 3/12* (2013.01); *B03C 3/16* (2013.01); *B03C 3/32* (2013.01); *B03C 3/41* (2013.01); *B03C 2201/10* (2013.01); *B03C 2201/18* (2013.01)

(58) Field of Classification Search
CPC combination set(s) only.
See application file for complete search history.

(56) References Cited

U.S. PATENT DOCUMENTS 3,960,505 A * 6/1976 Marks ..... 422/168
5,914,454 A * 6/1999 Imbaro et al. ..... 95/64
(Continued)

FOREIGN PATENT DOCUMENTS

FR 2.205.367 5/1974
FR 2.281.167 3/1976
(Continued)

OTHER PUBLICATIONS

Markus Sillanpää, et al., "High collection efficiency electrostatic precipitator for in vitro cell exposure to concentrated ambient particulate matter (PM)", Journal of Aerosol Science, 39, 2008, pp. 335-347.
(Continued)

*Primary Examiner* — Duane Smith
*Assistant Examiner* — Sonji Turner
(74) *Attorney, Agent, or Firm* — Oblon, McClelland, Maier & Neustadt, L.L.P.

(57) ABSTRACT

A device for collecting particles in air comprising a collecting chamber (4), a capillary tube (12) whereof one end (12.1) terminates in the chamber (4), a collecting electrode, the capillary tube (12) containing polarisable liquid. Sufficient difference in voltage is applied between the liquid and the collecting electrode (16) for a corona effect between the drop of liquid at the end of the capillary tube (12) and the collecting electrode (12) and the spraying of the drop (20) by electrospray. The corona discharge causes flow of air through the collecting chamber (4) and the electrospray ensures wetting of the collecting electrode (16).

22 Claims, 4 Drawing Sheets

(51) Int. Cl.

| | |
|---|---|
| ***B03C 3/16*** | (2006.01) |
| ***B03C 3/32*** | (2006.01) |
| ***B03C 3/41*** | (2006.01) |

(56) References Cited

U.S. PATENT DOCUMENTS

| | | | | |
|---|---|---|---|---|
| 6,156,098 | A | 12/2000 | Richards | |
| 6,831,271 | B1 * | 12/2004 | Guevremont et al. | 250/282 |
| 7,531,027 | B2 * | 5/2009 | Tepper et al. | 96/27 |
| 7,717,980 | B2 * | 5/2010 | Tepper et al. | 95/71 |
| 7,780,761 | B2 * | 8/2010 | Gu et al. | 95/66 |
| 8,241,397 | B2 * | 8/2012 | Gu et al. | 95/71 |
| 2002/0134932 | A1 * | 9/2002 | Guevremont et al. | 250/281 |
| 2003/0131727 | A1 * | 7/2003 | Fissan et al. | 95/58 |
| 2004/0023411 | A1 * | 2/2004 | Fenn | 436/174 |
| 2006/0185511 | A1 * | 8/2006 | Tepper | 95/71 |
| 2008/0121106 | A1 * | 5/2008 | Tepper et al. | 96/27 |
| 2008/0282772 | A1 * | 11/2008 | Petinarides | 73/31.02 |
| 2009/0114090 | A1 * | 5/2009 | Gu et al. | 95/66 |
| 2009/0235817 | A1 * | 9/2009 | Gu et al. | 95/79 |
| 2011/0192284 | A1 | 8/2011 | Sawyer et al. | |

FOREIGN PATENT DOCUMENTS

WO WO 2005/057748 A1 6/2005

WO WO 2007/012447 A1 2/2007

OTHER PUBLICATIONS

Gary Tepper, et al., "An electrospray-based, ozone-free air purification technology", Journal of Applied Physics, 102, 2007, 1 front page, pp. 113305-1 to 113305-6.

Gary Tepper, et al., "A New Air Sampler based on Electrically Charged Liquid Nanodroplets", Nanotechnology, 2006, IEEE-NANO 2006, vol. 2, pp. 781-782.

Gary Tepper, et al., "A study of ionization and collection efficiencies in electrospray-based electrostatic precipitators", Journal of Aerosol Science, 39, (7), 2008, pp. 609-617.

R. Bocanegra, et al., "Multiple electrosprays emitted from an array of holes", Journal of Aerosol Science, 36, (12), 2005, pp. 1387-1399.

Kyung-Hyun Choi, et al., "Effects of nozzles array configuration on cross-talk in multi-nozzle electrohydrodynamic inkjet printing head", Journal of Electrostatics, 69, 2011, pp. 380-387.

Michael S. June, et al., "Measuring efficiency of positive and negative ionic wind devices for comparison to fans and blowers", Journal of Electrostatics, 69, 2011, pp. 345-350.

French Preliminary Search Report issued Mar. 11, 2013, in French Application No. 12 53945 filed Apr. 27, 2012 (with English Translation of Categories of Cited Documents).

U.S. Appl. No. 14/406,795, filed Dec. 10, 2014, Marchalot, et al.

* cited by examiner

ELECTROSTATIC COLLECTING SYSTEM FOR SUSPENDED PARTICLES IN A GASEOUS MEDIUM

TECHNICAL FIELD AND PRIOR ART

The present invention relates to an electrostatic device for collecting particles suspended in a gaseous medium, more particularly in air.

Detection and analysis of particles present in ambient air is a major concern these days, whether for environmental monitoring with the presence of nanoparticles produced by human activity in ambient air, health problems with an evident need to protect populations from airborne pathogenic agents (Legionella, flu, etc.) and security issues (detection of biological attacks).

The electrostatic capture devices for airborne particles, known as electrofilters, are used to purify air, for example. There are also electrostatic devices for collecting and analysing particles. These devices are highly effective in collecting submicronic particles.

Of these devices, some are based on the use of an intense electrical field to create a corona discharge effect; they are currently called electrofilters or electrostatic precipitators.

An electrofilter (electrostatic precipitator (ESP)) is a mechanism which collects particles present in gas by application of an electrical field to a trajectory of particles suspended in this gas. More precisely, this strong electrical field (several thousands to tens of thousands of volts per centimetre near the discharge electrode) is caused by two electrodes arranged near each other: a first polarised electrode or discharge electrode, generally in the form of a wire or point, being arranged opposite a second electrode, the latter in the form of a counter-electrode, generally having flat or cylindrical geometry. The existing electrical field between the two electrodes ionises the volume of gas located in the inter-electrode space, and particularly a sheath or corona of ionised gas located around the discharge electrode. This phenomenon is called corona discharge. The resulting charges, migrating to the counter-electrode, charge the particles to be separated contained in the gas. The resulting charged particles migrate to the counter-electrode where they can be collected. This counter-electrode is usually called a collecting electrode. Due to the required level of the electrical field, a discharge electrode which has a very small radius of curvature has to be used. The discharge electrodes encountered are therefore generally either points or wires.

Electrofilters use high voltages to generate the discharge by corona effect.

Also, an electrofilter comprises means for carrying air from the environment through the device and means for transferring particles of a gaseous medium to an aqueous or culture medium.

Such a device is described for example in document WO 2007/012447. The discharge electrode is formed by a wire placed inside the cylindrical counter-electrode. A tube ensures steam supply between the discharge electrode and the counter-electrode. A pump is provided to entrain the air and aerosol mixture through the device. This device therefore needs an external pump which uses no high voltage, and steam supply.

Devices using the electrospray process have also been described for example in document "An electrospray-based, ozone-free air purification technology", Gary Tepper et al, Journal of Applied Physics, 102, 113305 (2007). The electrospray process sprays liquid into fine droplets. A device executing this process comprises two electrodes, one formed by a capillary guiding liquid to be sprayed and the other by a generally flat counter-electrode. The resulting drops are charged electrically and are dispersed in air containing the particles to be collected, and they transfer their charge to the polar particles which can be attracted and then collected by the counter-electrode. This device comprises a fan for circulating air through the device. This fan does not use high voltage.

These devices are very bulky due to the necessity of using a fan or a pump for circulating air. Also, they require the use of high voltages either to generate the corona discharge or to carry out the electrospray process, and another voltage source to power the pump or the fan.

Also, in the case of collecting airborne particles due for analysis, particles generally collected at the surface of an electrode must be recovered. For this, a culture medium can be deposited onto the surface of the collecting electrode or downstream of the latter.

EXPLANATION OF THE INVENTION

It is consequently an aim of the present invention to provide a collecting device for particles contained in gas, which has reduced footprint and is easier to manufacture relative to devices of the prior art.

This aim is attained by a collecting device whereof the liquid feed is configured to generate both the corona discharge and the electrospray process.

The corona discharge charges the particles to be separated for the purpose of capturing them on the collecting electrode. It also enables generation of ion wind for bringing air through the device.

The electrospray process generates charged droplets, reinforcing the efficacy of capture. It also ensures wetting of the electrode, which helps retain particles at the surface of the collecting electrode, or, beyond a certain rate, the runoff of particles along the collecting electrode for the purpose of evacuating or analysing them.

So, the collecting device no longer requires a pump or fan to ensure that air, or more generally gas, is carried through the device, and neither does it require any particular means to ensure transfer of the gaseous medium to the liquid medium. Also, the means for generating the corona discharge and the means for spraying the liquid by electrospray both use high voltages.

Also, the small footprint of the device makes it compatible with portable use.

Therefore, the means used to generate the corona discharge and those for obtaining the electrospray are combined, and the drop of polarised liquid located at the end of the capillary for spraying by electrospray forms the point of the discharge electrode for corona discharge.

In other words, a collecting device for particles is provided, using electrical force as the sole motor force to execute the functions of carrying gas, collecting particles, and transferring from the gas phase to the aqueous phase of the sample. Corona discharge and electrospray are combined to achieve this, providing a simplified collecting device needing no extra modules, such as pump, fan, etc., necessary for operating collecting devices of the prior art.

Advantageously, a decontamination function of the electrode can also be executed outside the particle-collecting phases. For this, a liquid capable of decontaminating the surface of the counter-electrode is sprayed by electrospray.

The subject-matter of the present invention is a collecting device for particles in a gaseous flow comprising:

a collecting chamber, comprising a collecting electrode, intake means of the gaseous flow in the collecting chamber, at least one capillary tube whereof a first end terminates upstream of the collecting electrode in the direction of flow of the gaseous flow through the collecting chamber and a second end is intended to be connected to a liquid tank, polarisation means of said liquid in the capillary tube, the capillary tube and the collecting electrode, to cause corona discharge and spraying of the liquid by electrospray of the collecting electrode.

The collecting device can also comprise evacuation means of said gaseous flow from the collecting chamber, said evacuation means being located downstream of said collecting electrode.

In an advantageous example, the collecting chamber is cylindrical and the collecting electrode has a corresponding cylindrical form. The collecting chamber can be tubular and the collecting electrode can have an annular form whereof the internal diameter is substantially equal to the internal diameter of the collecting chamber.

The ratio of the distance between the first end of the capillary tube and the collecting electrode on the internal diameter of the collecting electrode is advantageously in the range [0.5; 0.75], advantageously equal to 0.56.

For example, the collecting chamber comprises a lateral tubular wall and two bases forming longitudinal ends, and the intake means are formed by orifices passing through the lateral wall to the side of a first longitudinal end and the evacuation means are formed in the base located at the level of a second longitudinal end.

The difference in voltage applied between the liquid at the first end of the capillary tube and the collecting electrode is in the range [8 kV; 10 kV].

In an embodiment, the inner surface of the capillary tube is advantageously at least partly made of electrically conductive material and forms the polarisation means of the liquid it contains.

In another embodiment, the capillary tube is made of electrically insulating material and the polarisation means are formed by a polarisation electrode located inside the capillary tube.

In another embodiment, the polarisation means are located upstream of the capillary tube.

The device can advantageously comprise spraying decontamination means of the collecting electrode formed by the capillary tube, said capillary tube capable of being connected by its second end to a tank for decontamination liquid capable of being sprayed by electrospray, bleach for example.

According to an additional characteristic, the collecting electrode can be formed by a biological culture medium for the particles collected.

According to another additional characteristic, the collecting device can comprise a plurality of capillary parallel tubes. The collecting device preferably comprises a deflector enclosing the ends of the capillary tubes terminating in the collecting chamber, said deflector being intended to guide the droplets formed by electrospray. For example, the deflector is formed by a metal ring at the same potential as the liquid.

Another subject-matter of the present invention is a collecting system comprising a collecting device according to the invention and high-voltage power means for applying the difference or the differences in voltage.

This system can be advantageously portable.

The system can comprise an ion wind generator connected to said collecting chamber for boosting the rate of gas flow passing through the collecting chamber, said ion wind generator comprising a discharge electrode and a counter-electrode.

Another subject-matter of the present invention is a collecting and analysis system comprising a collecting system according to the invention and analysis means of particles captured by the collecting electrode, said analysis means being located downstream of said collecting electrode.

BRIEF DESCRIPTION OF THE DRAWINGS

The present invention will be better understood by way of the following description and the attached drawings, in which.

DETAILED EXPLANATION OF PARTICULAR EMBODIMENTS

Figure 1:
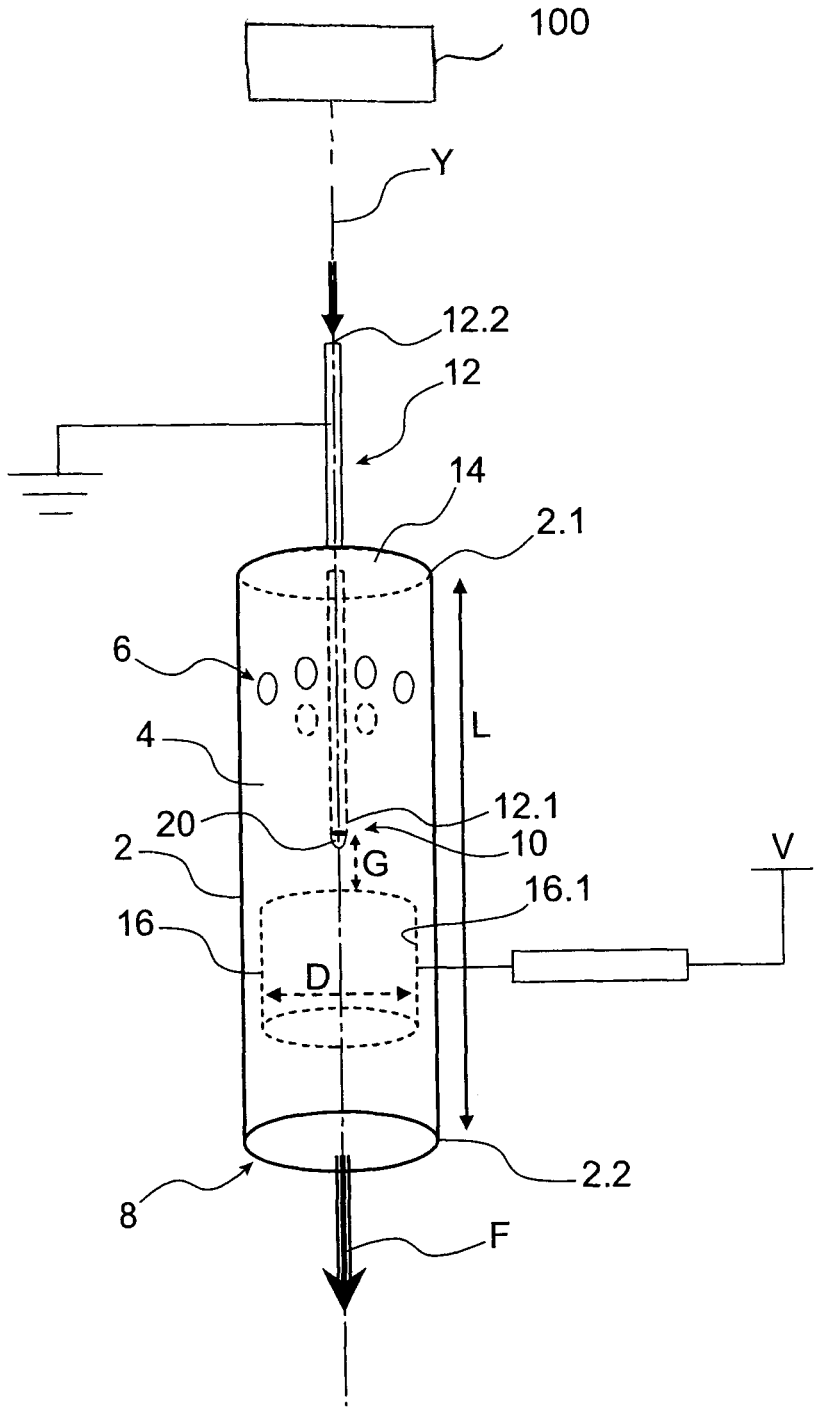
FIG. 1 is a schematic representation of an embodiment of a collecting device.

FIG. 1 shows an embodiment of a collecting device according to the invention shown schematically.

The example of the following description is the collecting of particles contained in air, also designated as airborne particles. It will be understood that the invention applies to collecting particles contained in any gaseous medium.

The device comprises a body 2 formed in the example shown by a tube, delimiting a collecting chamber 4, intake means 6 of the air in the chamber 4 and air evacuation means 8 from the chamber 4.

The tube 2 has a longitudinal axis Y; and is fitted with a longitudinal upstream end 2.1 and a longitudinal downstream end 2.2. The terms "upstream"and "downstream" are considered relative to the direction of treated gas flow through the device which is symbolised by the arrow F, the treated gas flowing from upstream to downstream.

The device also comprises means for generating a corona effect inside the chamber 4 and means for spraying liquid by electrospray, designated hereinbelow as "electrospray means".

In the example shown and particularly advantageously, the means for generating the corona discharge and the electrospray means are combined. These means will be designated as collecting means 10.

The collecting means 10 comprise a capillary tube 12 arranged in the example shown coaxially to the axis Y and mounted through a base 14 of the upstream end 2.1 of the tube 2.

The capillary tube 12 comprises a downstream end 12.1 terminating in the chamber 4 and an upstream end 12.2 designed to be attached to a liquid feed 100. The liquid is to be sprayed by electrospray. The liquid feed is obtained for example by means of a syringe pump or a pump.

The drop of liquid 20 present at the downstream end 12.1 of the capillary tube 12 forms the point of a discharge electrode.

The capillary tube 12 can be mounted mobile along the axis X so as to allow axial adjusting of the position of its downstream end 12.1 relative to a collecting electrode 16 which will be described hereinbelow. The discharge electrode is located upstream of the collecting electrode.

The collecting means 10 also comprise polarisation means of the liquid circulating in the capillary tube 12 for spraying. In the example shown, the polarization means are formed directly by the capillary tube 12 which is made of electrically conductive material and which is connected to a voltage source. This realisation has the advantage of further reducing the number of elements used in the invention.

Advantageously the capillary tube is connected to earth to prevent any short-circuit with external elements.

As a variant, it can be provided for the capillary tube 12 to be made of electrically insulating material and for an electrode connected to the voltage source to be arranged inside the tube upstream or at the level of the end 12.1 of the tube. The electrode is for example in the form of a wire extending along the axis of the capillary tube 12 or is fixed to the internal wall of the capillary tube. As another variant, it is feasible to polarise the liquid before it enters the capillary tube 12.

The collecting means also comprise a counter-electrode 16, also called collecting electrode, arranged downstream of the downstream end 12.1 of the capillary tube 12. The collecting electrode 16 is hollow and extends along the direction of flow and in this direction comprises a first end and a second end, the first and second ends being located downstream of the end 12.1 of the capillary tube 12.

In the example shown the counter-electrode 16 has the form of a cylinder of circular cross-section mounted in the tube 2. Advantageously, the internal diameter of the counter-electrode 16 is substantially equal to the internal diameter of the body 2 to reduce interruptions in diameter on the trajectory of the airflow. The inner surface of the chamber 4 is therefore substantially continuous. The form of the collecting electrode preferably corresponds to a part at least of the inner surface of the tube.

The inner surface 16.1 of the counter-electrode 16 forms the collecting surface of the particles. The counter-electrode is connected to a high-voltage source.

The counter-electrode 16 can take different forms of a cylinder of revolution. It can especially be in the form of one or more plates, between which capillaries terminate. It can also have the form of a portion of a cylinder, such as a semi-cylinder.

The intake means 6 comprise orifices made in the tube between the upstream end 2.1 of the tube and the downstream end of the capillary tube 12.

The evacuation means are located opposite intake means 6 relative to the downstream end 12.1 of the capillary tube 12.

The relative position of the edge of the drop of liquid 20 located at the downstream end 12.1 is such that the distance G separating the downstream end 12.1 of the capillary tube and the upstream end of the counter-electrode is not zero.

The operation of this device will now be described.

Liquid such as water is injected into the capillary tube 12 by means of a syringe pump and a drop of liquid 20 forms at the downstream end 12.1 of the capillary tube 12.

Figure 5:
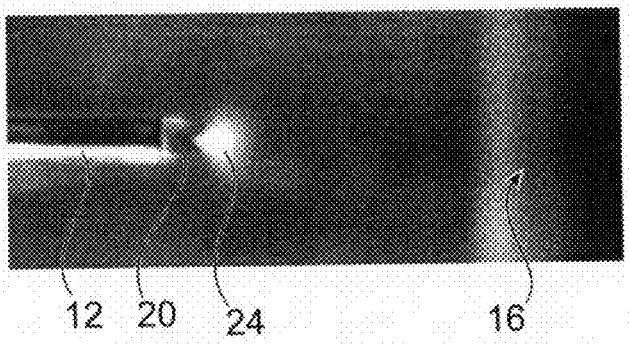
FIG. 5 is a photograph of the ionisation of air at the tip of the drop of water at the end of the capillary forming a discharge electrode in the form of a point.

High voltage is then applied to the counter-electrode 16, with the capillary tube 12 being grounded. The drop 20 is therefore polarised since the capillary tube is electrically conductive. The capillary 12 forms a needle, at the end of which the drop 20 forms a point, having a curve (or a small radius of curvature). A corona discharge 24 appears in the region of the drop 20 when the electrical field reaches a critical value; this discharge at the end of the drop 20 can be seen on the photograph of FIG. 5. As is known, corona discharge generates a pocket of ionise gas in the region of the discharge electrode. A unipolar wind of ions and charged particles develops at the level of the drop towards the counter-electrode 16 under the effect of Coulomb force. The air is carried along by transfer of some movement between these charged particles and the neutral particles and molecules in air.

Due to the position of the drop 20 at a distance from and upstream of the counter-electrode 16, air is effectively carried along from the intake means 6 to the evacuation means 8, in other words from upstream to downstream. In this way the particles are carried to the counter-electrode 16. An air aspiration phenomenon towards the interior of the chamber 4 now appears, as does a flow according to arrow F. The discharge electrode and the collecting electrode 16 now form an airflow generator.

As they migrate to the counter-electrode the ions produced by the discharge charge the particles to be separated. The resulting charged particles migrate to the counter-electrode 16, where they can be collected.

Simultaneously, the drop of liquid 20 located at the downstream end of the capillary tube 12, which forms the point of the discharge electrode, is subjected to electrostatic forces which tend to snatch it away from the tube, forming an electrospray. The drop 20 is snatched from the downstream end 12.1 of the capillary tube 12 when the electrostatic forces surpass the capillary forces, the latter tending to maintain the liquid in the capillary. Therefore, the electrostatic forces deform the drop until they wrench it away from the downstream end 12.1 of the capillary 12. The drop 20 is then sprayed into droplets of micrometric or nanometric sizes in the direction of the collecting electrode 16. The droplets formed in this way are charged electrically and are dispersed in the air containing the particles to be collected, and capture the particles circulating in the inter-electrode space. The latter are carried towards the collecting electrode 16 and then collected by the latter.

The droplets impact the collecting electrode 16, the effect of which is to wet the surface of the collecting electrode 16 and form a film of liquid on the electrode, ensuring transfer of particles from the gas phase to the liquid phase.

Also, the fact that the collecting electrode 16 is wet improves capture of the particles. In effect, this prevents them from being carried back by the airflow.

In addition, when the rate is sufficient this liquid film recovers the particles by runoff along the collecting electrode for their analysis or evacuation.

Finally, the film of liquid can serve as culture medium for biological particles.

For example, in the event where the device is used to effect capture of potentially pathogenic biological agents in air (virus, bacteria, etc.), a liquid beneficial to the survival of microorganisms is used as liquid to be sprayed, such as for example an aqueous solution comprising a saline buffer of PBS 1X and a Triton X surfactant at 0.1%.

The collecting of particles is therefore done at the same time by corona effect and the droplets are formed by electrospray. The production of ozone is therefore reduced relative to a collecting device using corona discharge only.

The combination of these two effects is particularly advantageous since, apart from collecting particles, it generates airflow through the device without an extra module and ensures transfer from the gas phase to the liquid phase.

The result is therefore an entirely integrated device.

The applied difference in potential is preferably between 8 kV and 10 kV.

For a difference in potential between 8 kV and 10 kV, the sprayed droplets are sufficiently deflected for them to reach the collecting electrode and collide with the inner surface of the collecting electrode and form a film of liquid on the inner surface of the collecting electrode. This range of potential ensures maximal collecting of particles.

In the case of insufficient difference in potential, for example between 3 kV and 8 kV, droplets are not deflected enough, they pass through the collecting electrode and collide with the internal wall of the tube downstream of the collecting electrode. These particles are not collected.

With respect to D the internal diameter of the collecting electrode 16, the G/D ratio is greater than or equal to 0.2, preferably greater than 0.5. The G/D ratio is preferably such that $0.5<G/D<0.75$, and even more preferably G/D is close to 0.5, equal to 0.56 for example. These G/D ratio values are beneficial to the appearance of exploitable ion wind.

If the G/D ratio is selected too low, for example less than or equal to 0.49, deflection of at least some of the droplets can be excessive, as they collide with the upstream end of the collecting electrode, and liquid can accumulate. This liquid forms an extension of the collecting electrodes towards the discharge electrode, the effect of which can reduce the distance between the discharge electrode and the collecting electrode, possibly causing electrical arcs to form. The length of the drop is therefore taken into account when the device is being dimensioned.

In the example shown, the liquid end of the capillary tube preferably forms the discharge electrode for corona discharge and ensures the electrospray effect at the same time.

The device according to the invention advantageously comprises means for ensuring decontamination of the collecting electrode between two capture cycles, for example between two pathogen capture cycles, making the device reusable.

The capillary tube 12 and the electrospray effect are used particularly advantageously to spray the internal wall of the collecting electrode 16 with adapted fluid, for example bleach, which is a strongly conductive aqueous solution.

Decontamination with bleach can be carried out very simply at the same point of operation as collecting by applying the same values of difference in voltage, the same liquid rate and same distance G. For example, an electrovalve is located between the upstream end 12.2 of the capillary tube and controls the fluid feed as a function of the preferred cycle, either to complete a collecting cycle or to complete a decontamination cycle.

Figure 2A:
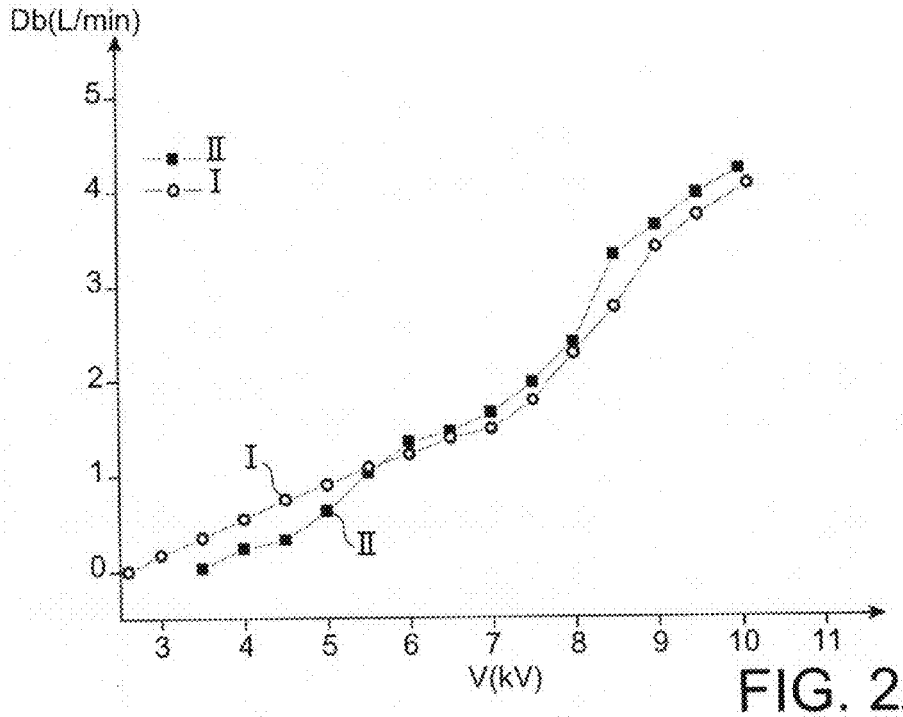
FIG. 2A is a graphic representation of the rate Db of air through the device as a function of the difference in voltage V applied between the discharge electrode and the collecting electrode for an aqueous solution comprising a saline buffer of PBS (Phosphate Buffered Saline) 1X and a surfactant of Triton X100 type at 0.1%, sprayed and for an aqueous solution of sprayed sodium chloride.

FIG. 2A shows the variation in the rate Db within the collecting device according to the invention presenting a G/D ratio of 0.56 as a function of the voltage V applied to the collecting electrode (the discharge electrode being grounded), the rate results from the flow obtained by corona discharge and the structure according to the invention. Measurements are taken in the event where the liquid is PBS 1×+Triton X at 0.1% (curve I) and in the event where the liquid is saltwater (curve II). Because of the invention there is also a rate of 21/min for voltage at the collecting electrode greater than or equal to 8 kV.

Figure 2B:
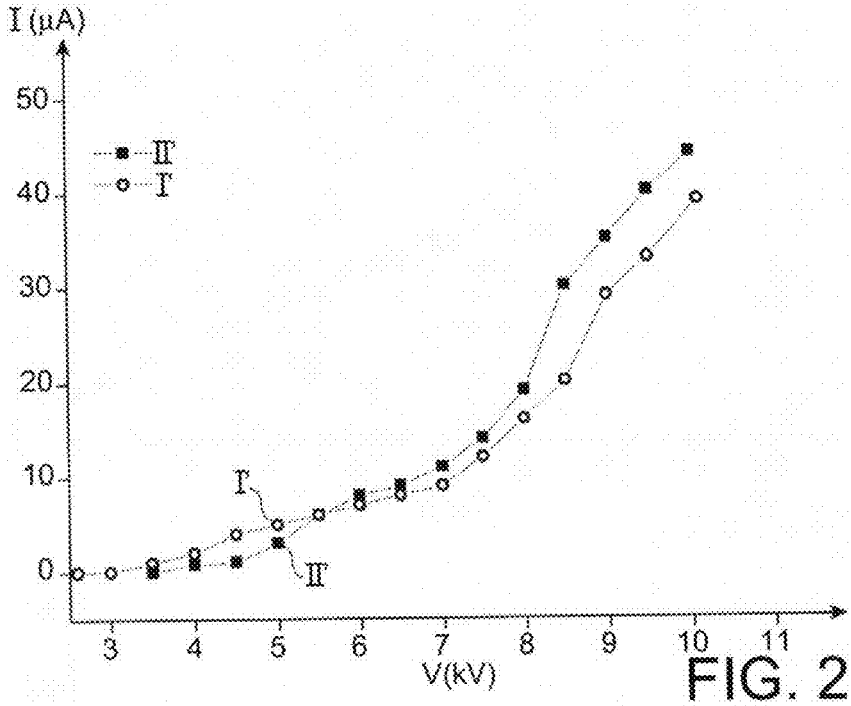
FIG. 2B is a graphic representation of the current I through the device as a function of the difference in voltage V applied between the discharge electrode and the collecting electrode for an aqueous solution comprising a saline buffer of PBS (Phosphate Buffered Saline) 1X and a surfactant of Triton X100 type at 0.1%, sprayed and for an aqueous solution of sprayed sodium chloride.

FIG. 2B shows the variation in current I within the collecting device according to the invention as a function of the voltage V applied to the collecting electrode. Measurements are taken in the event where the liquid is PBS 1X+Triton X at 0.1% (curve I') and in the event where the liquid is saltwater (curve II').

Saltwater and PBS 1X+Triton X at 0.1% are two strongly electrically conductive liquids. These measurements show that the device is very robust to change in liquid since it is strongly electrically conductive. The device can therefore be used with many liquids, making its field of application very wide in terms of particles which can be collected.

By way of example, for a device having the structure as in FIG. 1 and the body of which measures 100 mm and the internal diameter is equal to 10 mm, as well as the internal diameter of the collecting electrode, it has been measured that, in selecting the following operation point:

polarisation of the device at 10 kV, for a G/D ratio=0.56, a liquid rate of 5 μl/min, the following are obtained: an air rate of 4.2 l/min, average capture efficacy of 99.99%, and wetting of the inner wall of the collecting electrode for electrical consumption of 400 mW, which is very low.

The invention simultaneously produces substantial air entrainment, effective capture and adequate wettiing of the collecting electrode with low power consumption, as well as eliminating the formation of electrical arcs.

Figure 3A:
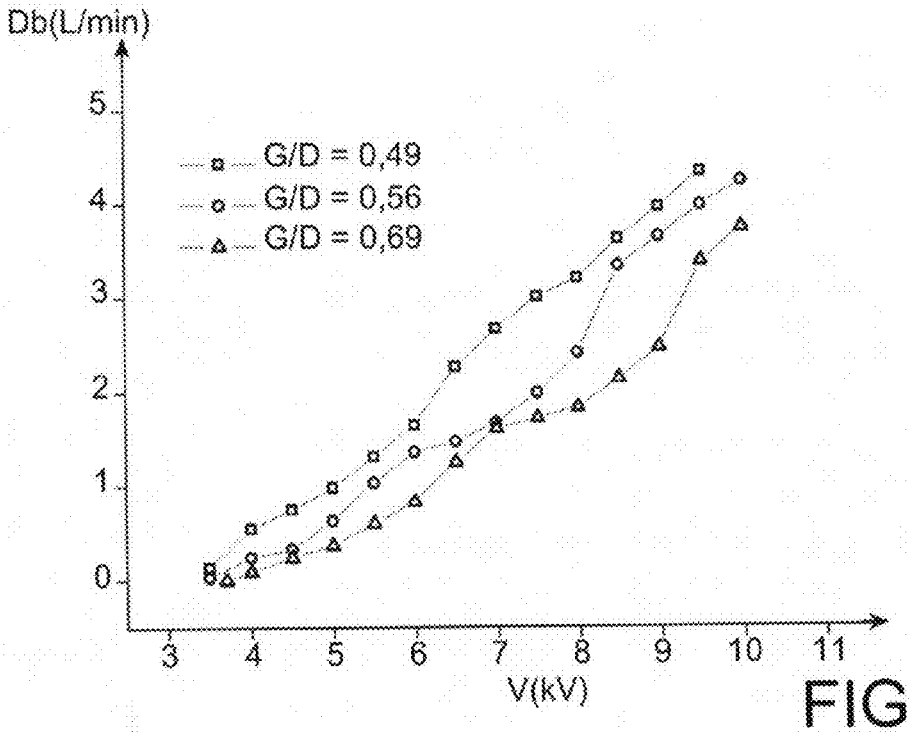
FIG. 3A is a graphic representation of the rate Db of air through the device as a function of the difference in voltage V applied between the discharge electrode and the collecting electrode for different values of the ratio G/D.
Figure 3B:
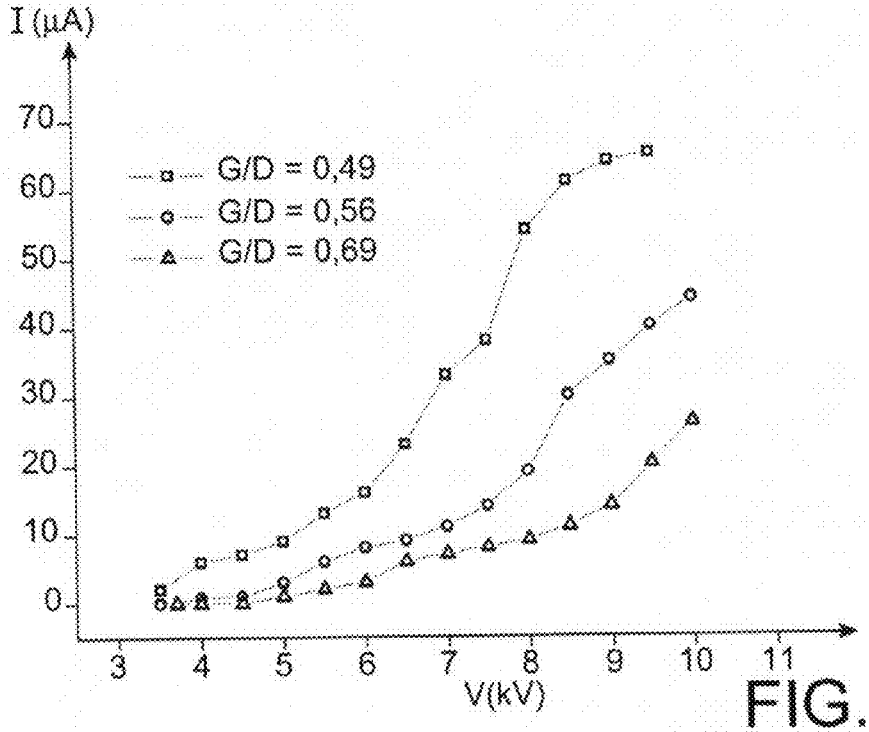
FIG. 3B is a graphic representation of the current I through the device as a function of the difference in voltage V applied between the discharge electrode and the collecting electrode for different values of the ratio G/D.

FIGS. 3A and 3B show the variations in rate and current as a function of voltage applied for different G/D ratios. The lower the G/D, the smaller G is in constant diameter, the greater the rate Db. However, it is evident that for the ratio G/D=0.49 power consumption is substantially greater. Also, when G/D=0.49, the curve in FIG. 3B has no measuring point at 10 kV since electrical arcs form for values of voltages higher than 9.5 kV due to proximity between the end of the capillary and the collecting electrode.

Yet the collecting device according to the invention operates with a G/D ratio of 0.49 and a voltage difference less than or equal to 9.5 kV.

Tables T1 and T2 following show the collection efficacy of the device according to the invention. For this, an isokinetic sampling rod connected to a particle counter is used, the whole being placed downstream of the collecting electrode and two series of measurements are conducted.

One series of measurements is conducted with the collecting device turned off and one series of measurements is conducted with the collecting device functioning.

Capture efficacy is calculated from the ratio of the number of particles passing through the collecting device when it is operating and when it is not operating, given that the concentration of particles in the air is constant.

$$\eta = 1 - \frac{N_{On}}{N_{Off}}$$

where q is the collecting efficacy, $N_{On}$ the number of particles exiting from the collecting device when operating and $N_{Off}$ the number of particles in the collecting device when turned off. It should be noted that when the collecting device is turned off, air is entrained solely via aspiration of the particle counter at the rate of 1.2 l/min. Values of $N_{On}$ and $N_{Off}$ for a few particle size ranges are given in Table T1. Given the low volume of air contained in the device (around 6 $cm^3$), it can be reasonably estimated that $N_{Off} \approx N_0$ where $N_0$ is the concentration of aerosol in ambient air.

TABLE T1

Average number of particles per liter of air for the collecting device turned off ($N_{Off}$) and when operating ($N_{On}$)

| Voltage applied to collecting electrode | Status of collecting device | Average number of particles per liter of air collected, the rod having a size between 0.25-0.28 μm | 0.35-0.40 μm | 0.70-0.80 μm | 3.5-4 μm |
|---|---|---|---|---|---|
| 10 kV | $N_{Off}$ | 136192 | 625925 | 405650 | 2900 |
| | $N_{On}$ | 7 | 8 | 0 | 0 |
| 7 kV | $N_{Off}$ | 127727 | 406263 | 351969 | 2670 |
| | $N_{On}$ | 470 | 247 | 331 | 0 |
| 4 kV | $N_{Off}$ | 127727 | 180183 | 232885 | 827 |
| | $N_{On}$ | 470 | 394 | 531 | 1 |

Table T2 lists the efficacies for a few particle diameter size ranges collected. Efficacy values similar to those presented in this table T2, that is, very close to 1, are also noted for the other measuring channels.

TABLE T2

A few capture efficacy values

| Voltage applied to the collecting electrode | Airflow measured (l/min) | Total airflow (L/min) | 0.25-0.28 μm Efficacy (%) | 0.35-0.40 μm Efficacy (%) | 0.70-0.80 μm Efficacy (%) | 3.5-4 μm Efficacy (%) | Average efficacy (%) |
|---|---|---|---|---|---|---|---|
| 10 kV | 3.7 ± 0.2 | 4.9 ± 0.2 | 99.99 | 99.99 | 100 | 100 | 99.99 |
| 7 kV | 1.8 ± 0.2 | 3 ± 0.2 | 99.83 | 99.93 | 99.90 | 100 | 99.93 |
| 4 kV | 0.2 ± 0.2 | 1.4 ± 0.2 | 99.63 | 99.78 | 99.77 | 99.9 | 99.83 |

The results obtained show minor dependence of the capture efficacy on the size of the particles: the smaller they are, the more difficult they are to capture even if efficacy is close to 100%.

The combination of electrospray and corona discharge creates optimal collecting efficacy.

In Table T2, two rates of air are given for each voltage.

The measured rate is that indicated by a flow meter downstream of the rod. The total rate is equal to the sum of the rate measured by the flow meter and of the rate of aspiration of the particle counter (1.2 l/min). The rate of air produced and the capture voltage are coupled as is therefore shown by FIG. 3A at 4 kV, a potential for which corona discharge does not appear, while the entrainment of air produced by the collecting device according to the invention is almost zero. These results show the effect of the collecting device according to the invention on entrainment of air through the collecting chamber.

In another embodiment, the device can comprise several capillary tubes to boost the rate of liquid sprayed on the inner wall of the collecting electrode. This enables runoff of particles collected along the collecting electrode 16.

In the embodiment using several capillaries, the device preferably comprises a deflector guiding the sprayed drops to the collecting electrode.

Figure 4:
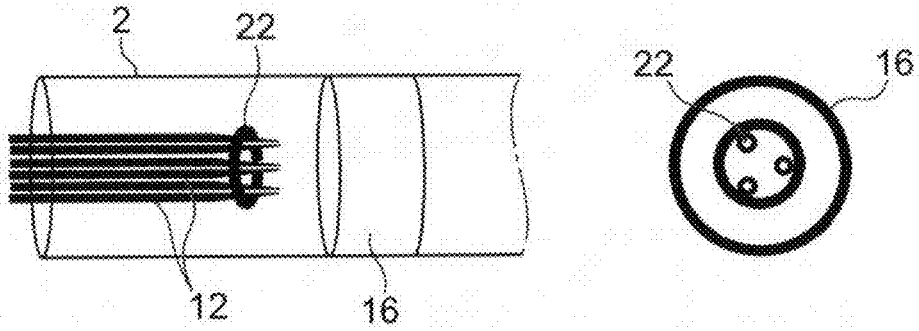
FIG. 4 is a schematic representation of an embodiment of a discharge electrode having several capillaries.

FIG. 4 shows an example of this deflector 22. It is a metal ring arranged around the capillary tubes 12 at the level of their downstream ends 12.1. The deflector 22 is at the same electrical potential as the points of the capillaries.

Since the deflector 22 is polarised in the same way as the ends of the capillaries, field lines form between this deflector 22 and the counter-electrode 16. These field lines act as an electrostatic channel and force the droplets to move towards the counter-electrode 16. In the absence of such a deflector, the drops, which have the same polarity, would tend to eject each other, which would give a divergent beam of drops. With the deflector, the field lines formed between the deflector and the counter-electrode exert a repelling force on the drops such that the drops are held in the conical envelope formed by the field lines.

In the illustrated example the collecting electrode 16 is formed by a metal tube. The edges of the longitudinal ends are preferably rounded to reduce the risk of generating electrical discharges. This collecting electrode can be made of any conductive material, such as metallic material or non-metallic materials such as gel or a conductive membrane whereof the electrical potential is fixed by the electrical means accompanying the device. These non-metallic supports can be for example a biological culture medium so the electrode is directly beneficial to microorganism culture.

The use of such supports is described for example by M. Sillanpää and col. (2007) M. Sillanpää, M. D. Geller, H. C. Phuleria, C. Sioutas, High collection efficiency electrostatic precipitator for in-vitro cell exposure to concentrated ambient particulate matter (PM), Aerosol Science 39 (2007) pp. 335-347.

The collecting device according to the invention is particularly adapted to the use of a collecting electrode directly forming a culture medium. In fact, spraying via electrospray as per the invention advantageously ensures humidification of the culture medium during collecting to prevent its desiccation and increases the total sampling duration. It has been noted that desiccation of the culture medium limits the total sampling duration, generally to about ten minutes.

The collecting electrode can also comprise an electrically conductive annular or cylindrical support and is covered by thin electrical insulation, typically less than 500 μm thick.

The liquid ejected by electrospray is water, for example. In the case of micro-organism collecting, this is preferably an aqueous solution beneficial to survival and/or the culture of microorganisms such as for example physiological serum, a solution of phosphate buffered saline (PBS), an aqueous solution containing at least one antioxidant.

In another embodiment, placing a collecting device according to the invention and an ion wind generator of annular point-electrode type in series can be considered. In the latter, the discharge electrode can have the form of one or more points to boost the rate of air carried along.

The collecting device can of course be associated with analysis means of particles collected and now in liquid phase on the collecting electrode. The analysis means generally used in the field of airborne particle analysis are appropriate and will not be described in more detail here.

Accordingly, the invention provides a collecting device offering considerable compactness and greatly reduced power consumption, for example of the order of 400 mW. The latter can therefore be integrated into a portable case of the order of 10 $cm^3$ adapted to portable use for detection of pathogens in the widest range of contexts: hospitals, industrial plants (biomedical, agriculture . . . ) or even to combat bioterrorism.

The invention claimed is:

1. A device for collecting particles in a gaseous flow comprising:

a collecting chamber, comprising a tubular collecting electrode, an intake of the gaseous flow in the collecting chamber, at least one capillary tube having a first end which terminates upstream of the entire tubular collecting electrode in the direction of flow of the gaseous flow through the collecting chamber, and a second end which is configured to be connected to a liquid tank, and polarisation device which polarizes said liquid in the capillary tube so as to make a difference in potential between the liquid at said first end of the capillary tube and the collecting electrode to cause corona discharge and spraying of the liquid by electrospray in the direction of the collecting electrode.

2. The collecting device according to claim 1, in which the first end of the capillary tube terminates at a non-zero distance, according to the direction of the flow of the gas, from an upstream end of the collecting electrode.

3. The collecting device according to claim 2, in which the ratio of the distance G between the first end of the capillary tube and the upstream end of the collecting electrode to the internal diameter D of the collecting electrode is greater than or equal to 0.2.

4. The collecting device according to claim 2, in which the ratio of the distance G between the first end of the capillary tube and the upstream end of the collecting electrode to the internal diameter D of the collecting electrode is greater than or equal to 0.5.

5. The collecting device according to claim 2, in which the ratio of the distance G between the first end of the capillary tube and the upstream end of the collecting electrode to the internal diameter D of the collecting electrode is in the range [0.5; 0.75].

6. The collecting device according to claim 1, in which the collecting chamber is tubular and the internal diameter of the collecting electrode is substantially equal to the internal diameter of the collecting chamber.

7. The collecting device according to claim 1, comprising an evacuation of said gaseous flow of the collecting chamber, said evacuation being located downstream of said collecting electrode.

8. The collecting device according to claim 7, in which the collecting chamber comprises a lateral tubular wall and two bases forming longitudinal ends, and in which the intake is formed by orifices passing through the lateral wall to the side of a first longitudinal end and the evacuation is formed in the base located at the level of a second longitudinal end.

9. The collecting device according to claim 1, in which the difference in voltage applied between the first end of the capillary tube and the collecting electrode is in the range [8 kV; 10 kV].

10. The collecting device according to claim 1, in which the inner surface of the capillary tube is at least partly made of electrically conductive material and forms the polarisation device of the liquid which it contains.

11. The collecting device according to claim 1, in which the capillary tube is made of electrically insulating material and the polarisation device is formed by a polarisation electrode located inside the capillary tube.

12. The collecting device according to claim 1, in which the polarisation are located upstream of the capillary tube.

13. The collecting device according to claim 1, comprising a device for spraying decontamination of the collecting electrode, said device being formed by the capillary tube, said capillary tube being configured to be connected by its second end to a tank of decontamination liquid capable of being sprayed by electrospray.

14. The collecting device according to claim 1, in which the collecting electrode is formed by a biological culture medium for the particles collected.

15. The collecting device according to claim 1, comprising a plurality of parallel capillary tubes.

16. The collecting device according to claim 15, comprising a deflector enclosing the ends of the capillary tubes terminating in the collecting chamber, said deflector being configured to guide the droplets formed by electrospray.

17. The collecting device according to claim 16, in which the deflector is formed by a metal ring at the same potential as the liquid.

18. A collecting system comprising a collecting device according to claim 1 and high-voltage power generator for applying the difference or the differences in voltage.

19. The collecting system according to claim 18, in which the system is portable.

20. The collecting system according to claim 18, comprising an ion wind generator connected to said collecting chamber for increasing the rate of gaseous flow passing through the collecting chamber, said ion wind generator comprising a discharge electrode and a counter-electrode.

21. System for collecting and analysis, comprising a collecting system according to claim 18 and an analyser of particles captured by the collecting electrode, said analyser being located downstream of said collecting electrode.

22. The collecting device according to claim 1, wherein an axis of the capillary tube is substantially coaxial with an axis of the collecting electrode.

* * * * *